US006068125A

United States Patent [19]

Slaters, Jr. et al.

[11] Patent Number: 6,068,125

[45] Date of Patent: May 30, 2000

[54] METHOD AND APPARATUS FOR STORING AND DISPENSING CONTAINER CARRIERS

[75] Inventors: Arthur R. Slaters, Jr., Arlington Heights, Ill.; Victor I. Deonarine, Macedonia, Ohio; F. Ronald Seager, Naperville; Dennis J. Boyd, Schaumburg, both of Ill.

[73] Assignee: Illinois Tool Works Inc., Glenview, Ill.

[21] Appl. No.: 09/084,557

[22] Filed: May 26, 1998

[51] Int. Cl.[7] ..... B65D 85/62; B65B 63/04

[52] U.S. Cl. ..... 206/494; 53/429; 206/390; 206/493; 206/499; 206/820

[58] Field of Search ..... 206/449, 555, 206/556, 390, 820, 499, 494, 493; 221/39; 53/429, 48.5

[56] References Cited

U.S. PATENT DOCUMENTS

| | | | |
|---|---|---|---|
| 3,285,405 | 11/1966 | Wanderer . | |
| 3,459,329 | 8/1969 | Mochizuki et al. | 221/34 |
| 3,578,155 | 5/1971 | Small et al. | 206/820 X |
| 3,729,367 | 4/1973 | Shore et al. | 206/494 X |
| 4,201,029 | 5/1980 | Lerner et al. | 53/429 |
| 4,585,145 | 4/1986 | Pitroda | 206/556 X |

*Primary Examiner*—Bryon P. Gehman
*Attorney, Agent, or Firm*—Pauley Petersen Kinne & Fejer

[57] ABSTRACT

An apparatus and method for packaging planar container carriers. A package of fan folded container carriers having a carton with vertical walls and a moveable platform positioned with respect to a bottom of the carton. Stacks of fan folded planar container carriers are then positioned in the cartons using a method for packaging wherein each stack of fan folded planar container carriers are secured with dividers positioned within the cartons. At least one carton is positioned on a base of the package to accommodate at least one additional stack of container carriers. The method is performed so that the package accommodates successive stacks of container carriers to form a generally continuous strip of container carriers.

16 Claims, 5 Drawing Sheets

METHOD AND APPARATUS FOR STORING AND DISPENSING CONTAINER CARRIERS

BACKGROUND OF THE INVENTION

1. Field of the Invention

This invention relates to a package for storing container carriers in a space-efficient manner for later dispensing the container carriers in a time-efficient manner.

2. Description of Prior Art

Container carriers connect two or more containers into a sturdy unitized package of containers. Container carriers are generally planar arrays of rings, sometimes referred to as "six-pack carriers," typically formed from a thermoplastic sheet material. Container carriers are produced so that large numbers of container carriers are formed end to end resulting in continuous elongated strips of container carriers. Unless specified otherwise, container carriers as used in this specification are defined as the continuous elongated strip of container carriers prior to application onto containers and subsequent division into individual container carriers.

Prior art methods of packaging container carriers involve accumulating the elongated strips of container carriers onto reels. The reels of container carriers are unwound at a later time during application onto containers. The reel method of storing and applying the container carriers to containers requires splicing the end of one reel with the beginning of the following reel without interrupting the application process. The reel method of storing and applying carriers is generally limited to reels of a size which may be physically lifted and manipulated by the applicating machine operators. Also, the reel unwinding equipment must accommodate the inertia and resultant backlash inherent in unwinding a wound strip of material. Further, the generally circular or octagonal shape of the reels limits the number of reels which may be assembled onto a single pallet for shipment between the production facility and the application facility.

Wanderer, U.S. Pat. No. 3,285,405, discloses a method for storing and dispensing container carriers wherein elongated strips of container carriers are fan folded, like pin-feed computer paper, into a box that accommodates a single lane of container carriers. The container carriers are dispensed from the box during the application process and successive boxes containing individual stacks of container carriers are spliced together as the boxes empty. However, the Wanderer patent does not disclose any method or apparatus for packaging multiple stacks of container carriers in a single package.

SUMMARY OF THE INVENTION

It is one object of this invention to provide a package of container carriers which allows for space-efficient storage of multiple stacks of container carriers.

It is another object of this invention to provide a package of container carriers which allows for dispensing large numbers of container carriers without requiring frequent replacement of the empty package and subsequent splicing of the container carriers in the replacement package.

It is still another object of this invention to provide a package of container carriers that maintains multiple stacks of container carriers in discrete lanes within the package.

It is another object of this invention to provide a package of container carriers that does not employ a reel mechanism.

It is yet another object of this invention to provide a method for assembling a package of container carriers that results in an efficiently filled package and permits uninterrupted removal of a mostly continuous elongated strip of container carriers.

A package of container carriers for shipment and storage and subsequent application to groups of containers is constructed to contain fan folded stacks of container carriers. Elongated strips of container carriers are fan folded, like pin-feed computer paper, into a plurality of stacks of container carriers.

The package comprises a plurality of cartons having vertical walls extending from a bottom of the carton. The carton contains an equal number of platforms or number of lanes. Each platform in the carton is preferably vertically moveable with respect to the vertical walls and the bottom. Each platform preferably supports at least one stack of container carriers and is moveable in the same horizontal plane in synchronization with the other platforms. The package contains at least one divider, preferably positioned in a vertical position with respect to the bottom of each carton for accommodating and supporting at least one stack of container carriers. The dividers may either be positioned between or through stacks of container carriers.

A method for assembling the package described above comprises loading one or more stacks of container carriers into one or more cartons. The cartons filled with stacks of container carriers are subsequently shifted to accommodate additional stacks of container carriers adjacent to the last stack of container carriers loaded into the package. Preferably, each stack of container carriers is separated and/or supported using the dividers.

In another method according to this invention, the divider and the bottom are external to the package while container carriers are fan folded onto the bottom. The bottom may comprise a plurality of platforms, each platform supporting a stack of fan folded container carriers. Container carriers are preferably fan folded onto the platform and over the dividers so that the dividers extend through cutouts in and/or between stacks of container carriers. Platforms filled with stacks of container carriers are transferred from a folding area to an assembly area with a base, such as a pallet, where they are inserted into the package. The transferred platforms are then replaced with a new empty group of platforms in the folding area which are also subsequently loaded with additional stacks of container carriers. This process is repeated until the base is full of platforms holding stacks of container carriers.

Regardless of the method employed, each subsequent stack of container carriers that is added to the package is preferably connected to the previous stack of container carriers. This ensures that a continuous stream of container carriers may be withdrawn from the package during application of the container carriers to containers.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
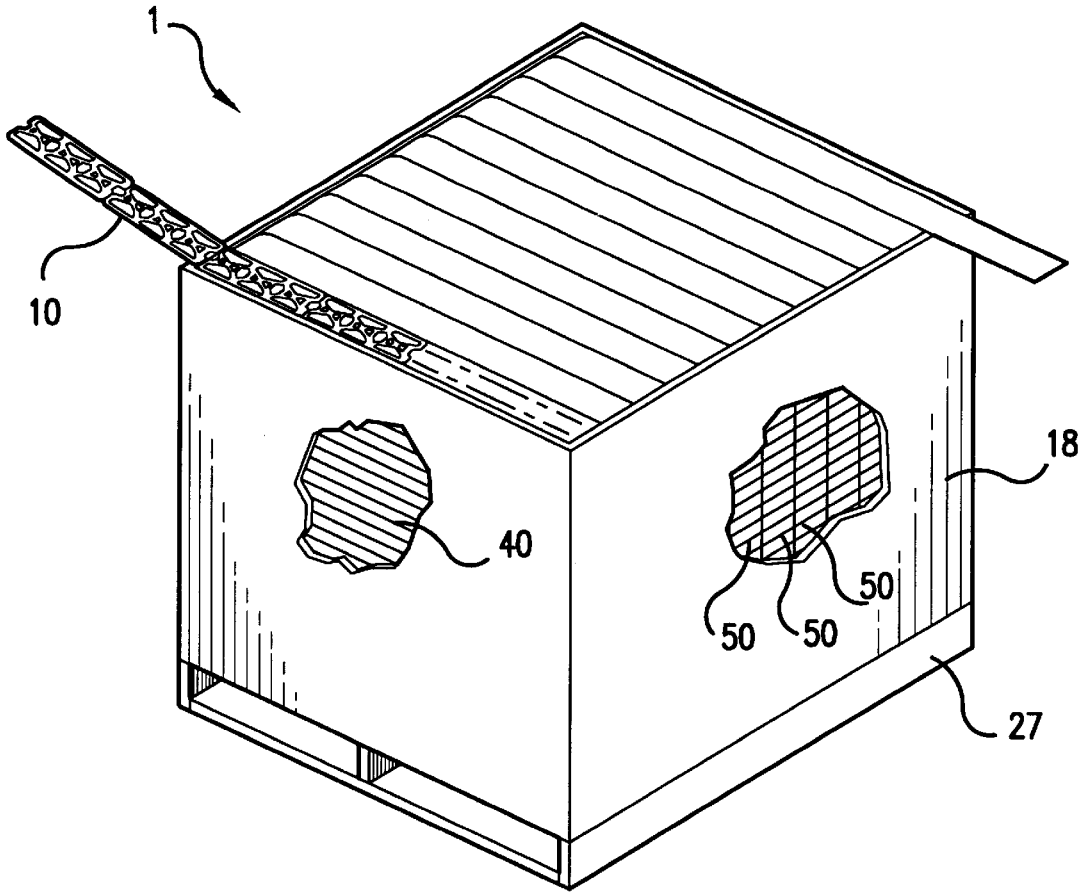
FIG. 1 is a perspective view of a container carrier package, according to one preferred embodiment of this invention.

FIG. 1 shows package 1 of container carriers 10 according to one preferred embodiment of this invention. Container carriers 10 are preferably arranged in an elongated strip having weakened areas between adjacent individual container carriers. During the production process, container carriers 10 are preferably formed in the elongated strip for shipment and storage in packaging, such as package 1. After shipment to an application facility, such as a soft drink bottler, container carriers 10 are preferably removed from the packaging and applied to groups of containers, such as cans, during which application container carriers 10 are separated from the elongated strip and into individual container carrier packages.

Figure 2:
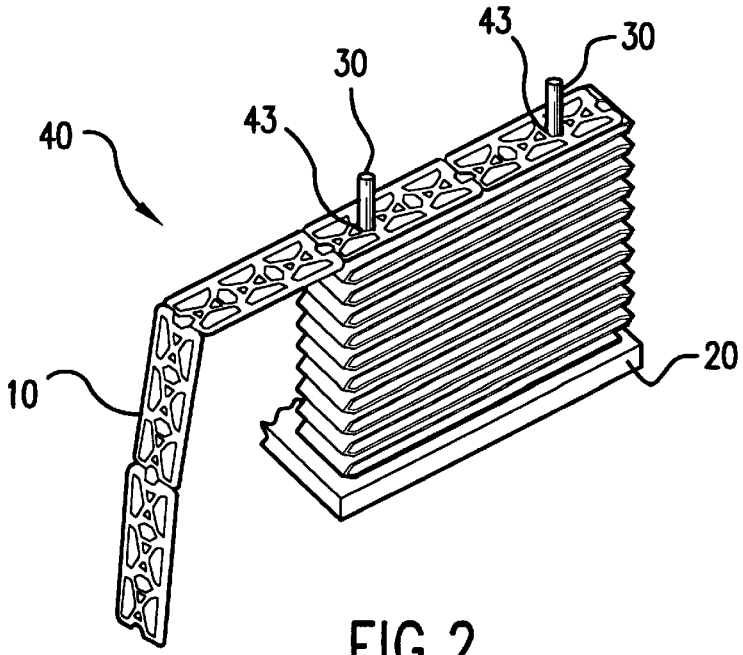
FIG. 2 is a diagrammatic view of a stack of container carriers, according to another preferred embodiment of this invention.

FIG. 2 shows a single fan folded stack 40 of container carriers 10 on bottom 20 of package 1 according to one preferred embodiment of this invention. The elongated strip of container carriers 10 are preferably fan folded back and forth in alternating opposite directions resulting in horizontally extending rows of container carriers 10 forming a vertically extending stack 40. Fan folding container carriers 10, like pin-feed computer paper, results in stack 40 wherein a large amount of container carriers 10 are folded into a minimum amount of space. Package 1 according to one preferred embodiment of this invention accommodates a plurality of stacks 40 of container carriers 10.

As shown in FIG. 1, package 1 comprises at least one vertical wall 18, although in a preferred embodiment of this invention, package 1 has four vertical walls 18. Vertical walls 18 are preferably constructed from corrugated cardboard. Vertical walls 18 may be constructed from sturdier materials, such as plastic, to create a more solid, reusable package 1.

Figure 4:
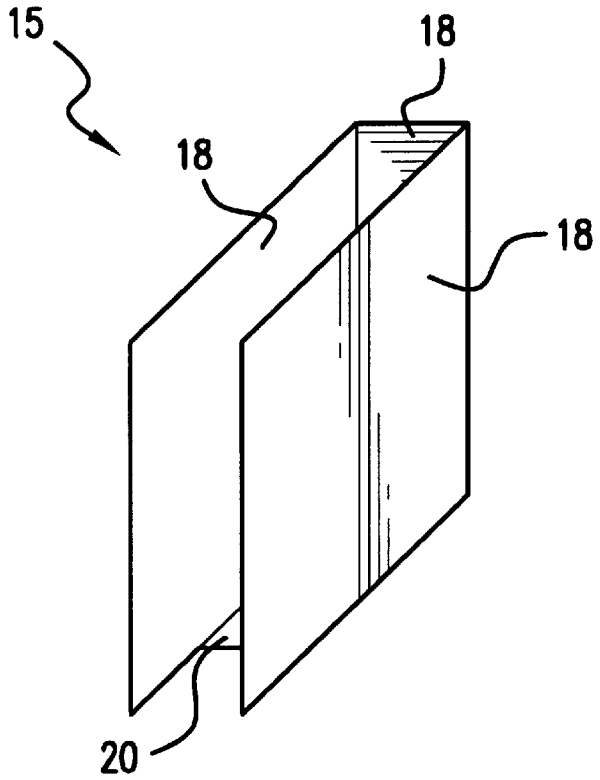
FIG. 4 is a perspective view of a carton according to one preferred embodiment of this invention.
Figure 7:
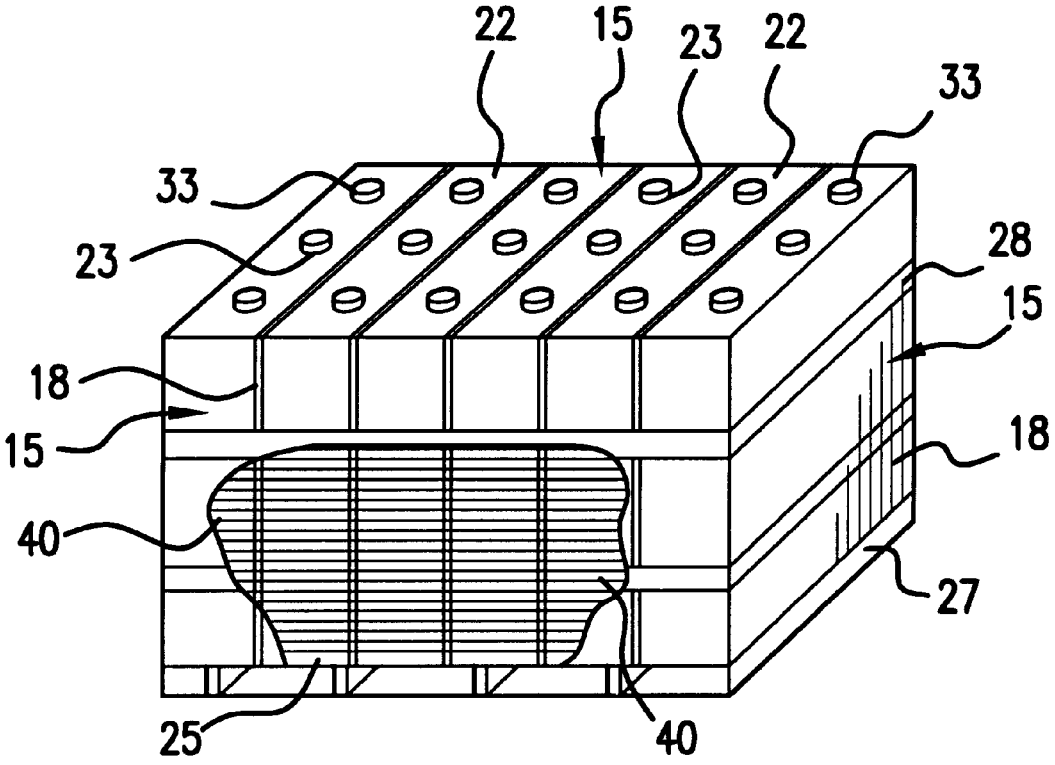
FIG. 7 is perspective view of a package according to a preferred embodiment of this invention.

In a preferred embodiment of the invention shown in FIG. 7, package 1 comprises a plurality of cartons 15 positioned within package 1. In this preferred embodiment of the invention, vertical walls of package 1 comprise vertical walls 18 of the plurality of cartons 15. Carton 15, shown in one preferred embodiment in FIG. 4, may comprise three or four vertical walls 18. However, prior to loading with container carriers 10, carton 15 preferably is not fully enclosed on all sides.

Each vertical wall 18 of carton 15 preferably extends from bottom 20 of carton 15. In one preferred embodiment of this invention, platform 25 is positioned with respect to bottom 20 so that platform 25 is vertically moveable with respect to vertical wall 18. Bottom 20 is preferably planar and generally square or rectangular to accommodate a plurality of adjacent stacks 40 of container carriers 10.

Figure 3:
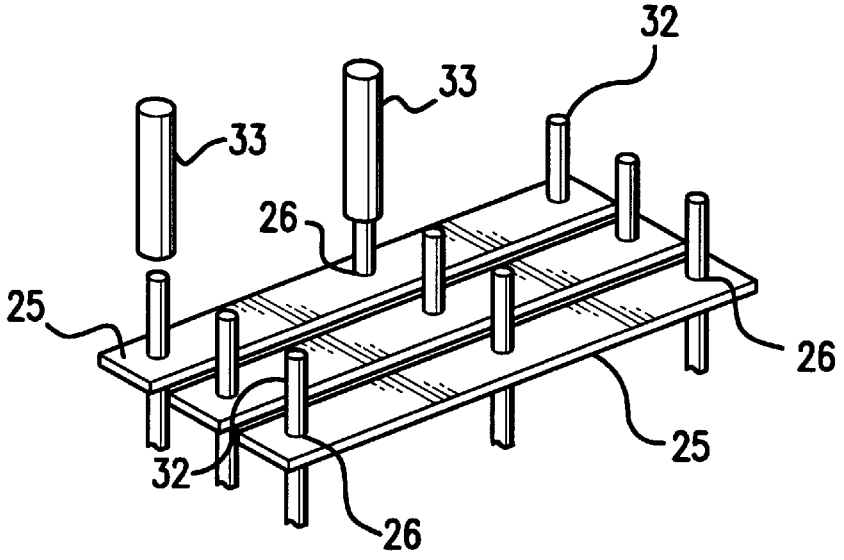
FIG. 3 is a perspective view of a movable platform and dividers according to one preferred embodiment of this invention.
Figure 6:
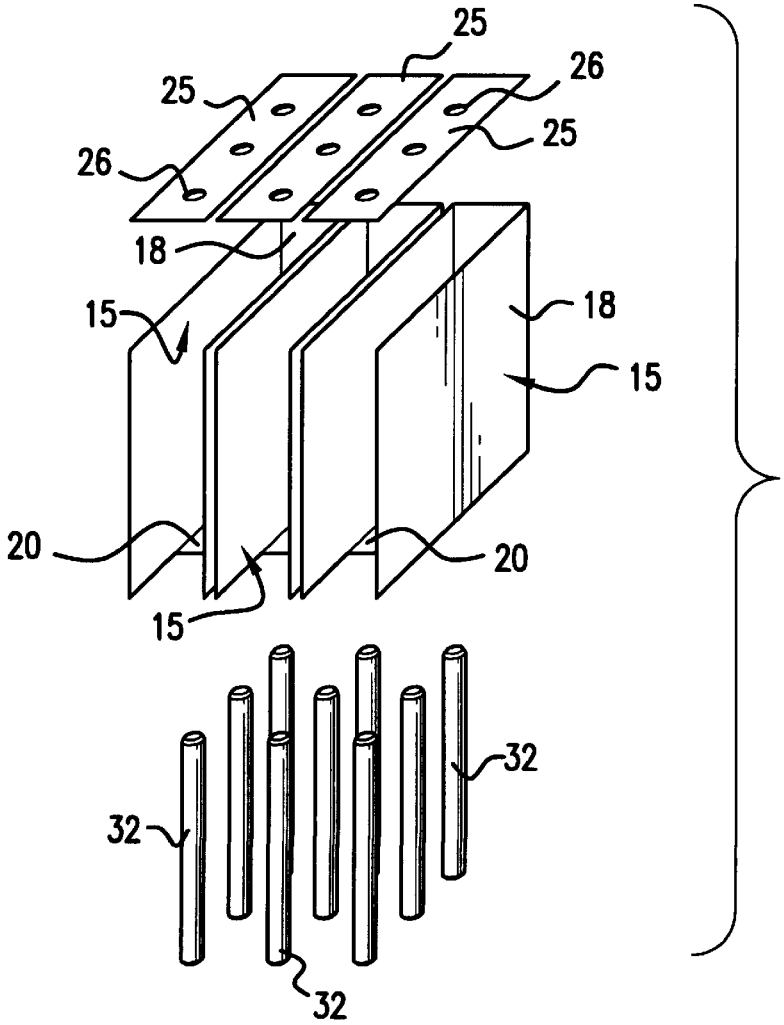
FIG. 6 is a diagrammatic exploded perspective view of a plurality of cartons, platforms and dividers according to one preferred embodiment of the invention.

In a preferred embodiment of this invention shown in FIG. 3, platform 25 is positioned with respect to bottom 20 of package 1 and/or carton 15. Preferably, platform 25 is at least as wide as a width of stack 40 of container carriers 10. Therefore, each platform 25 can accommodate at least one stack 40 of container carriers 10. Platforms 25 are preferably constructed from corrugated cardboard although sturdier materials such as plastic may be used to create platforms 25 that are more durable. As best shown in FIGS. 3 and 6, platforms 25 preferably contain platform apertures 26 or other means that permit passage of dividers 30, including temporary dividers 32 and/or permanent dividers 33, which are discussed below, through platforms 25.

In one preferred embodiment of this invention, carton 15 contains at least one divider 30, shown in FIGS. 2, 3 and 6, preferably positioned in a vertical position with respect to bottom 20 of carton 15. Dividers 30, which may include temporary dividers 32 and/or permanent dividers 33, are preferably positioned within carton 15 and define one or more lanes 50. Each lane 50 accommodates at least one stack 40 of container carriers 10, and preferably only one stack 40 of container carriers 10 is placed in each lane 50.

Figure 5:
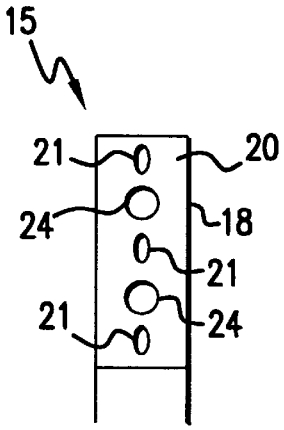
FIG. 5 is a bottom view of the carton shown in FIG. 4.

In one preferred embodiment of this invention, divider 30, 32, 33 forms a column extending between bottom 20 of carton 15 and a top of at least one stack 40 of container carriers 10. Divider 30, 32, 33 is connected with respect to bottom 20 of carton 15, such as within divider aperture 21 shown in FIG. 5, to restrict radial movement of divider 30, 32, 33. In this preferred embodiment of the invention, divider 30, 32, 33 may form a tube, a solid cylinder, an elongated triangular rod, an elongated rectangular rod or any other shape appropriate for dividing and/or indexing stacks 40 of container carriers 10. Divider 30, 32, 33 may be positioned between stacks 40 of container carriers 10 or, in another preferred embodiment of this invention, divider 30, 32, 33 supports each stack 40 of container carriers 10.

Divider 30, 32, 33 supports stack 40 of container carriers 10 by extending through at least one cutout 43 preferably formed through each stack 40 of container carriers 10. In this preferred embodiment of the invention, divider 30, 32, 33 prevents excessive movement of stack 40 within package 1 with respect to vertical walls 18. As shown in FIGS. 3, 6 and 7, in one preferred embodiment of this invention, three dividers 30, 32, 33 are positioned within each lane 50 to support stack 40 within package 1. Divider 30, 33 is preferably removable from the carton when pulled in an axial direction from within cutouts 43 in container carriers 10. In another preferred embodiment of the invention, cutouts 43 may also be contained along outside edges of container carriers 10 so that dividers 30, 32, 33 extend through cutouts 43 between adjacent stacks 40 of container carriers 10.

In another preferred embodiment of this invention not shown in the drawings, divider 30 comprises a planar element extending between bottom 20 of package 1 and the top of stack 40 of container carriers 10. In this preferred embodiment, the planar element, such as a sheet of corrugated cardboard, is positioned within package 1 to create physical lanes 50 within package 1. Stacks 40 of container carriers 10 are then positioned within lanes 50 formed by dividers 30.

FIG. 7 shows assembled package 1 with a plurality of cartons 15 having vertical walls 18, platforms 25, dividers 30, 32, 33 and a corresponding plurality of stacks 40 of container carriers 10. Package 1 preferably further comprises removable top 22 and base 27. Removable top 22 is preferably positioned with respect to vertical walls 18 of package 1 and protects the contents of package 1 from ultraviolet light, dirt and other contaminants. In one preferred embodiment of the invention, removable top 22 contains top apertures 23 which maintain the radial position of a top portion of dividers 30, 33. Base 27, preferably a pallet, is positioned underneath bottom 20 to facilitate transport of package 1 and provide support for package 1. Base 27 also may fix the vertical position of platforms 25 once package 1 is loaded with container carriers 10. Bands 28 or shrink wrap may also be applied to package 1 to create a sturdy package for shipping, handling and storage.

It is estimated that the package according to one preferred embodiment of this invention can include 12% more individual container carriers per pallet than a conventional reel package. Additionally, the package according to one preferred embodiment of this invention will save an estimate 14% in packaging costs over conventional reel packaging.

A method for assembling package 1 of container carriers 10 is required that results in an efficiently filled package 1 and permits uninterrupted removal of a mostly continuous elongated strip of container carriers 10.

As discussed above, carton 15 is divided with at least one divider 30, 32, 33. In one preferred embodiment of this invention, carton 15 having vertical walls 18 is loaded with at least one stack 40 of container carriers 10. In one preferred embodiment of this invention, multiple cartons 15 are simultaneously loaded with multiple stacks 40 of container carriers 10. After a first group of one or more cartons 15 is loaded with at least one stack 40 of container carriers 10, package 1 is shifted to accommodate at least one additional group of one or more cartons 15. Preferably, though not necessarily, each stack 40 of container carriers 10 is separated and/or positioned using one or more dividers 30, 32, 33. Dividers 30, 32, 33 maintain position of and spacing between the various stacks 40 of container carriers 10 which helps prevent tangling and other problems encountered during loading and unloading of package 1.

As shown in FIG. 3 and discussed above, a plurality of platforms 25 may be positioned with respect to bottom 20 of package and/or carton 15. In a preferred embodiment of this invention each separate platform 25 is loaded with stack 40 of fan folded container carriers 10. Container carriers 10 are preferably fan folded onto platform 25 over dividers 30, 32, 33 so that dividers 30, 32, 33 extend through cutouts 43 in and/or between container carriers 10.

In one preferred embodiment of this invention, a first group of one or more platforms 25 are preferably loaded simultaneously with one or more corresponding stacks 40 of container carriers 10 at a folding area. When each of the first group of platforms 25 are fully loaded, the first group of platforms 25 are transferred from the folding area to an assembly area with base 27, such as a pallet, where they are inserted into package 1. The first group of platforms 25 are then replaced with an additional group of empty platforms 25 in the folding area which are also subsequently loaded with additional stacks 40 of container carriers 10. The first group of platforms 25 is then moved within the loading area, preferably by shifting base 27, and the additional group of loaded platforms 25 is subsequently transferred to base 27. This process is repeated until base 27 is full of platforms 25 holding stacks 40 of container carriers 10. In this preferred embodiment of the invention, cartons 15 may have preexisting vertical walls 18 or vertical walls 18 may be added to package 1 during assembly.

In another preferred embodiment of this invention best shown in FIG. 6, platforms 25 are used in conjunction with temporary dividers 32. Temporary dividers 32 are preferably constructed from steel or other material appropriate for use in packaging machinery. Temporary dividers 32 are used to position and align each stack 40 of container carriers 10 in the folding area as container carriers 10 are fan folded onto platforms 25. Prior to final assembly of package 1, temporary dividers 32 are removed and replaced with permanent dividers 33 for shipping. In one preferred embodiment of the invention, temporary dividers 32 slide upwards through divider apertures 21 in carton 15 and through platform apertures 26 in platform 25, preferably prior to folding container carriers 10 onto platforms 25.

According to one preferred embodiment of this invention, permanent dividers 33 are positioned in package 1 in place of the temporary dividers 32. Permanent dividers 33, shown in FIG. 3, are preferably constructed from a lightweight, reusable or disposable material such as plastic or cardboard. In one preferred embodiment of this invention, permanent dividers 33 are elongated plastic tubes. Permanent dividers 33 preferably extend through cutouts 43 in stacks 40 of container carriers 10 from bottom 20 of carton 15 to a top of stack 40 of container carriers 10. Permanent dividers 33 preferably slide over or through temporary dividers 32 so that the permanent dividers 33 maintain the position of container carriers 10 with respect to package 1, preferably through cutouts 43 in container carriers 10. In a preferred embodiment of this invention, permanent divider 33, such as an elongated tube, slides downward and over temporary divider 32, such as an elongated rod, which extends upward from bottom 20 of carton 15. The step of replacing permanent dividers 33 with temporary dividers 32 may be performed before or after container carriers 10 are fan folded onto platform 25.

In a preferred embodiment of this invention, platform 25 is in a raised position with respect to dividers 30, 32, 33 and carton 15 prior to loading container carriers 10 into carton 15. As container carriers 10 are fan folded onto platform 25 over dividers 30, 32, 33, stack 40 increases in height as platform 25 is lowered a corresponding height with respect to carton 15. Therefore, when carton 15 is completely full, platform 25 is preferably positioned on bottom 20 of carton 15. Platform supports, not shown, may be used to dynamically adjust the height of platform 25 with respect to carton 15 during the loading process. Platform supports preferably pass through support apertures 24, shown in FIG. 5, in bottom 20 of carton 15.

In a preferred embodiment of this invention, each additional stack 40 of container carriers 10 that is added to package 1 is connected to the previous stack 40 of container carriers 10. Preferably, an end container carrier at a bottom of a first stack 40 of container carriers 10 is connected with a beginning container carrier at a top of an additional stack 40 of container carriers 10. The end container carrier is preferably connected or spliced with the beginning container carrier using a weld attachment or a heat seal. Adjacent stacks 40 of container carriers 10 may also be connected using other methods known to those having skill in the art.

Figure 8:
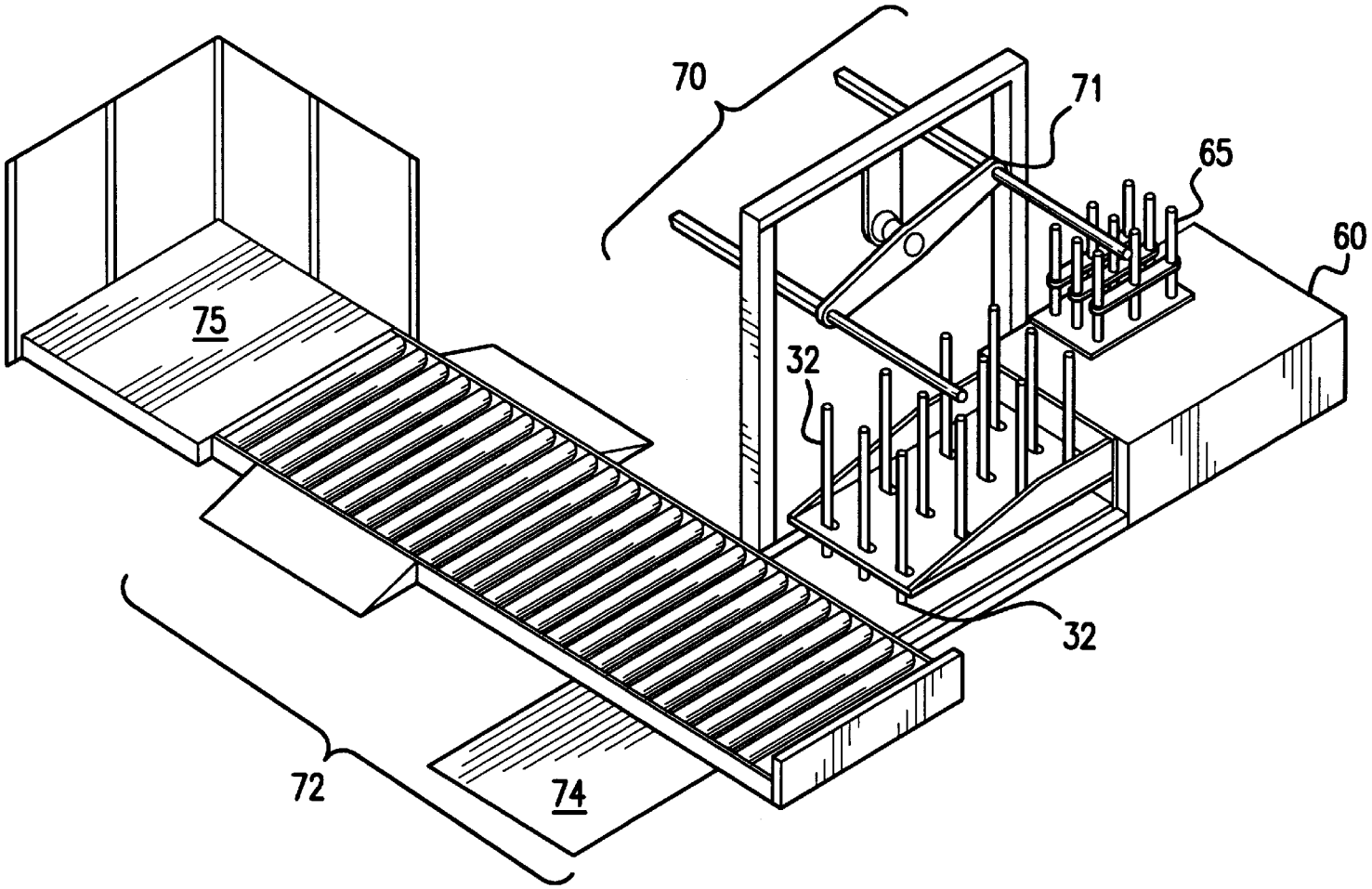
FIG. 8 is a schematic of a packaging area according to one preferred embodiment of this invention.

In a preferred embodiment of the invention, container carriers 10 are produced and packaged in a series of distinct steps shown in FIG. 8. Initially, container carriers 10 are manufactured in production area 60. Continuous lengths of container carriers 10 are fed through an accumulating area 65 which results in a constant in-feed tension to folding area 70. In folding area 70 container carriers 10 are folded over temporary dividers 32 to form multiple discrete lanes 50 of stacks 40 of container carriers 10. Folding means 71, such as a reciprocating see-saw arm, are used to fold container carriers 10 in fan-folded stacks 40. Although not shown in FIG. 8, cartons 15 and permanent dividers 33 are preferably also positioned in folding area 70 with respect to temporary dividers 32 to accommodate stacks 40 of container carriers 10.

After temporary dividers 32 are loaded with stacks 40 of container carriers 10, stacks 40, preferably in cartons 15, are moved to assembly area 72. Assembly area may include base 27 for supporting stacks 40 of container carriers 10 in cartons 15. Additional container carriers 10 are subsequently folded into stacks 40 and moved to assembly area 72 until package 1 is full of container carriers 10. In one preferred embodiment of the invention, reserve area 74 is used to store one or more stacks 40 of container carriers 10 for replacement of defective or incomplete stacks 40 in package 1.

When package 1 is full, package 1 is moved from assembly area 72 to shipping area 75 where bands 28, top 22 and/or other packaging components are applied to facilitate shipment or storage of package 1. Package 1 is then ready for subsequent use for generally continuous and uninterrupted application of container carriers 10 to containers. Free ends of container carriers 10 in each adjacent lane 50 are preferably welded together to form a continuous length of container carrier 10 within package 1.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

We claim:

1. A package of planar container carriers comprising:

a plurality of cartons, each carton having at least one vertical wall and a vertically moveable platform;

at least one stack of fan folded container carriers positioned on the vertically moveable platform within each carton; and at least one divider positioned within each carton for securing the at least one stack of fan folded planar container carriers, wherein the at least one divider extends through at least one cutout formed through at least one stack of fan folded container carriers.

2. The package of claim 1 further comprising a removable top positioned with respect to the at least one vertical wall of at least one carton of the cartons.

3. The package of claim 1 wherein the at least one divider comprises a column extending between a bottom of the carton and a top of the at least one stack of fan folded container carriers.

4. The package of claim 1 wherein three dividers are removably positioned vertically within each carton for securing the at least one stack of fan folded planar container carriers.

5. The package of claim 1 comprising six cartons of fan folded container carriers.

6. The package of claim 1 further comprising a base for supporting the plurality of cartons.

7. A package of planar container carriers comprising:

a carton having at least one vertical wall and a vertically moveable bottom;

at least one divider positioned vertically within the carton for dividing the carton into a plurality of lanes; and at least two stacks of fan folded planar container carriers, at least one stack of the planar container carriers positioned in each of the lanes, wherein the at least one divider extends through at least one cutout formed by each of the stacks of fan folded container carriers.

8. The package of claim 7 wherein the bottom is segmented to form a plurality of platforms, each one of the plurality of platforms supporting at least one stack of the planar container carriers.

9. The package of claim 7 further comprising a removable top positioned with respect to the at least one vertical wall of the carton.

10. The package of claim 7 further comprising at least one band wrapped around the carton.

11. The package of claim 7 wherein the at least one divider comprises a column extending between the bottom of the carton and a top of at least one stack of fan folded container carriers.

12. The package of claim 7 wherein the at least one divider comprises a planar element extending between the bottom of the carton and a top of at least one stack of fan folded container carriers.

13. A method for packaging planar container carriers comprising:

dividing a carton with at least one divider;

inserting at least one first stack of fan folded container carriers into the carton;

positioning the at least one first stack of fan folded container carriers on a base to accommodate at least one additional stack of container carriers; and extending the at least one divider through at least one cutout formed by each of the stacks of fan folded container carriers.

14. The method of claim 13 wherein the at least one divider is a temporary divider.

15. The method of claim 13 further comprising positioning a vertically movable platform beneath each stack of fan folded container carriers.

16. The method of claim 13 further comprising connecting an end container carrier of the stack of container carriers with a beginning container carrier of the at least one additional stack of fan folded container carriers.

* * * * *